US009568024B2

(12) United States Patent
Cen

(10) Patent No.: US 9,568,024 B2
(45) Date of Patent: Feb. 14, 2017

(54) FAN HOUSING WITH ENCIRCLING RINGS

(71) Applicant: Zhejiang Joyo Electric Appliance Technology Co., Ltd., Ningbo, Zhejiang Province (CN)

(72) Inventor: Daiyu Cen, Ningbo (CN)

(73) Assignee: ZHEJIANG JOYO ELECTRIC APPLIANCE TECHNOLOGY CO., LTD., Ningbo (CN)

( * ) Notice: Subject to any disclaimer, the term of this patent is extended or adjusted under 35 U.S.C. 154(b) by 389 days.

(21) Appl. No.: 14/291,251

(22) Filed: May 30, 2014

(65) Prior Publication Data

US 2015/0204348 A1 Jul. 23, 2015

(30) Foreign Application Priority Data

Jan. 20, 2014 (CN) ..... 2014 2 0032079 U

(51) Int. Cl.
*F04D 29/70* (2006.01)
*F04D 29/64* (2006.01)

(52) U.S. Cl.
CPC ..... *F04D 29/703* (2013.01); *F04D 29/646* (2013.01)

(58) Field of Classification Search
CPC ..... F04D 29/70; F04D 29/703; F04D 29/646; F05B 2260/30; F05B 2260/301
USPC ..... 416/247 R; 415/121.2
See application file for complete search history.

(56) References Cited

U.S. PATENT DOCUMENTS 1,713,946 A * 5/1929 Buckley ..... F04D 25/12 415/121.2
5,131,352 A * 7/1992 Hoshino ..... F01P 5/06 123/41.49
6,364,618 B1 * 4/2002 Moreno ..... F04D 29/703 403/13

(Continued)

FOREIGN PATENT DOCUMENTS

DE 4337631 A1 * 5/1995 ..... B29C 45/00
WO WO 2011010838 A2 * 1/2011 ..... G01C 9/28

*Primary Examiner* — Marina Tietjen
(74) *Attorney, Agent, or Firm* — Jiwen Chen

(57) ABSTRACT

The invention discloses a fan housing with encircling rings, comprising a front housing and a rear housing, wherein the front and rear housings are respectively provided with a circular encircling ring which is used for mutual fixing; multiple protruding ends are provided on the inner wall of the front encircling ring, while multiple slots are correspondingly provided on the outer wall of the rear encircling ring, so that the front and rear housings can be fastened together through match of the protruding ends and the slots; the front housing is provided with a handling cover; a fixing device, which comprises a draw bar, a spring and a pressing plate, is provided at one slot of the rear encircling ring. While mounting, pulling up the draw bar of the fixing device at first, aligning and fastening the protruding ends of the front housing and the slots of the rear housing correspondingly, then releasing the draw bar after primary fastening, the draw bar of the fixing device being back to the normal position because of elastic force of the spring, thus to finish fixing process; the handling cover can be used to rotate the whole front housing. By adopting proposal of the invention, it is very convenient to mount and dismantle the fan housing, so it is easy to clean internal parts like fan blades.

4 Claims, 3 Drawing Sheets

(56) References Cited

U.S. PATENT DOCUMENTS

| | | | | |
|---|---|---|---|---|
| 6,454,537 | B1 * | 9/2002 | Perella | F04D 29/703<br>416/247 R |
| 8,821,129 | B2 * | 9/2014 | Heli | B01D 46/001<br>416/247 R |
| 2004/0033131 | A1 * | 2/2004 | Susek | F04D 29/703<br>415/121.2 |

* cited by examiner

FAN HOUSING WITH ENCIRCLING RINGS

The present application claims the priority benefit of Chinese Application No. 201420032079.1, filed Jan. 20, 2014, which is hereby incorporated by reference.

TECHNICAL FIELD

The invention belongs to fan field, specifically relating to a fan housing with encircling rings.

BACKGROUND ART

Currently, main structure of the fan on the market includes a fan body, a fan blade and a base. The fan body is used to support the fan blade, the motor, buttons and the power cord. Generally, there are front housing and rear housing in front of and behind the fan blade; the front housing is used to protect the fan blade and provide uniform airflow, and the rear housing is used to fix the rear-mounted motor. The housing can prevent accidents caused by high-speed rotation of the fan blade; therefore, fixing of the two housings are very important. However, the front and rear housings of the fan on the market are generally connected by screws directly, which is difficult to mount and dismantle and further causes problem of cleaning the fan blades. After working for some time, it is troublesome to dismantle the housings by unscrewing to clean the parts inside the housing.

SUMMARY OF THE INVENTION

In order to solve the above problem, the invention discloses a fan housing with encircling rings, which can be conveniently dismantled.

The technical proposal of the invention is as follows: a fan housing with encircling rings, comprising a front housing and a rear housing, wherein the front and rear housings are respectively provided with a circular encircling ring which is used for mutual fixing; multiple protruding ends are provided on the inner wall of the front encircling ring, while multiple slots are correspondingly provided on the outer wall of the rear encircling ring, so that the front and rear housings can be fastened together through match of the protruding ends and the slots; besides, the front housing is provided with a handling cover at the center, and the handling cover protrudes relative to surface of the front housing, with multiple concave parts provided at the lateral sides; a fixing device, which comprises a draw bar, a spring and a pressing plate, is provided at one slot of the rear encircling ring; wherein the pressing plate is fixed under one slot of the rear encircling ring through screw, and is provided with a first through hole, through which the draw bar is in clearance fit with the pressing plate; the draw bar is provided with a top lug boss and is sleeved with a spring, and top end of the spring leans against the top lug boss and bottom end of the spring leans against the pressing plate; a second through hole is provided on the protruding end of the front encircling ring, and a third through hole is provided at bottom of the slot on the rear encircling ring, the second through hole and the third through hole is aligned with the first through hole of the pressing plate during fastening, and the three through holes are all in clearance fit with the draw bar.

Further, there are four concave parts uniformly distributed on lateral side of the handling cover.

Further, the fixing device further comprises a lock sleeve, and a bottom lug boss is provided at bottom of the draw bar; the lock sleeve is sleeved on the draw bar and limited by the bottom lug boss.

Further, the lock sleeve is provided with a lower extension surface, on which a lower mounting hole is provided, and an upper extension surface with an upper mounting hole is provided on the pressing plate at the corresponding position; the lock sleeve and the pressing plate are fixed by mounting a bolt in the mounting hole.

While mounting, pulling up the draw bar of the fixing device through the lock sleeve at first, the spring being pressed at this time, aligning and fastening the protruding ends of the front housing and the slots of the rear housing correspondingly to finish primary fastening; at this time, the first through hole of the pressing plate, the third through hole at bottom of the slot on the rear encircling ring and the second through hole on the protruding end of the front encircling ring are aligned; then releasing the lock sleeve, under action of electric force of the spring, the draw bar of the fixing device being passed through the first through hole of the pressing plate, the third through hole at bottom of the slot on the rear encircling ring and the second through hole on the protruding end of the front encircling ring, thus to finish the fixing; and at last, aligning the upper mounting hole of the lock sleeve and the lower mounting hole of the pressing plate, and fixing through the bolt. While dismantling, the bolt between the lock sleeve and the pressing plate being removed at first, then pulling up the draw bar through the lock sleeve, rotating the front encircling ring to make it apart from the rear encircling ring. At the same time, the handling cover on the front encircling ring can be used to rotate the whole front housing, so it is convenient for mounting and dismantling, and the concave parts on the handling cover can be used for handling and preventing it from slipping. By this technical proposal, it is very convenient to mount and dismantle the front and back housings, and it is easy to clean the internal parts like the fan blades.

DETAILED DESCRIPTION OF THE PREFERRED EMBODIMENTS

Figure 1:
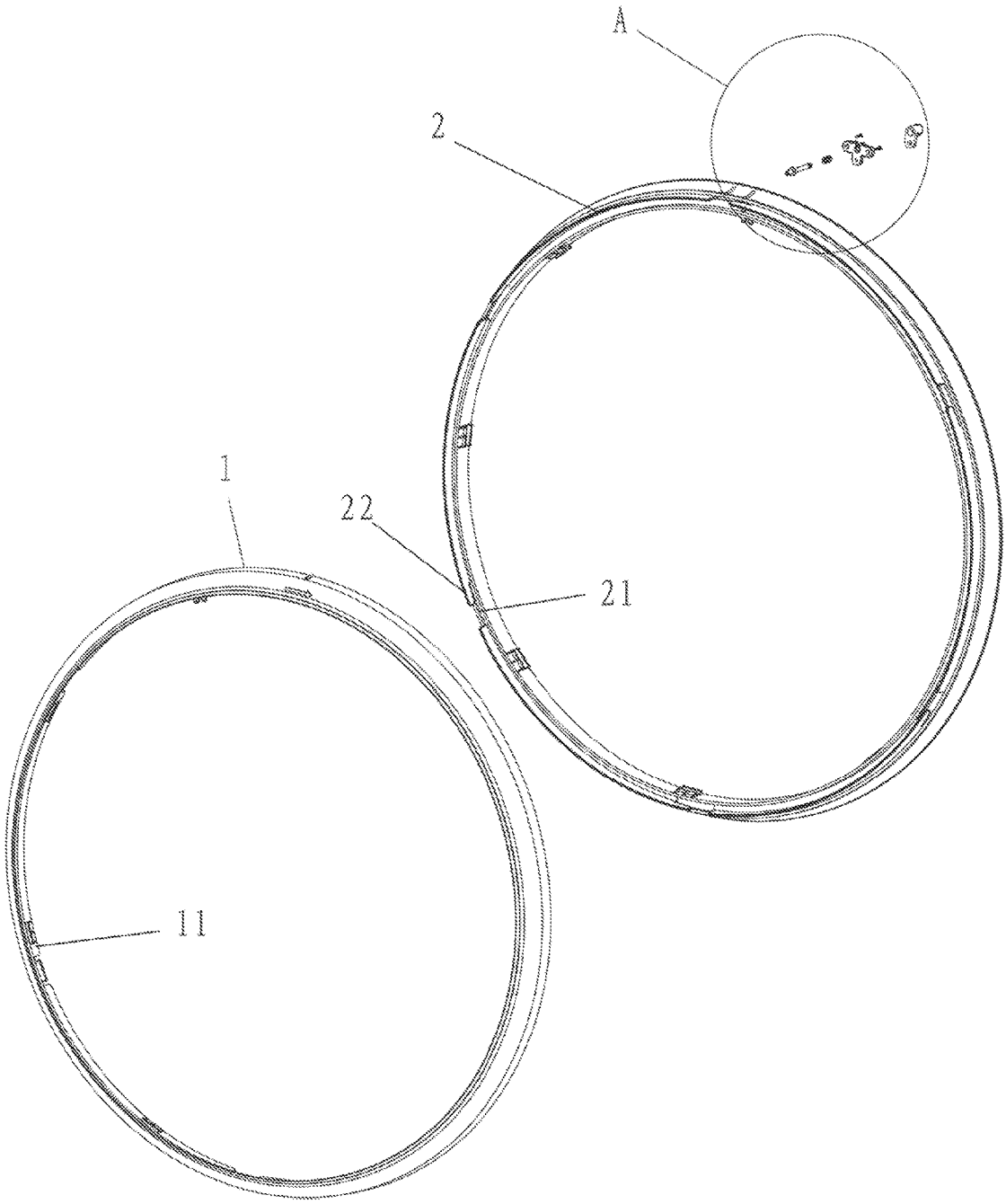
FIG. 1 is the schematic diagram of the encircling ring of the embodiment.
Figure 2:
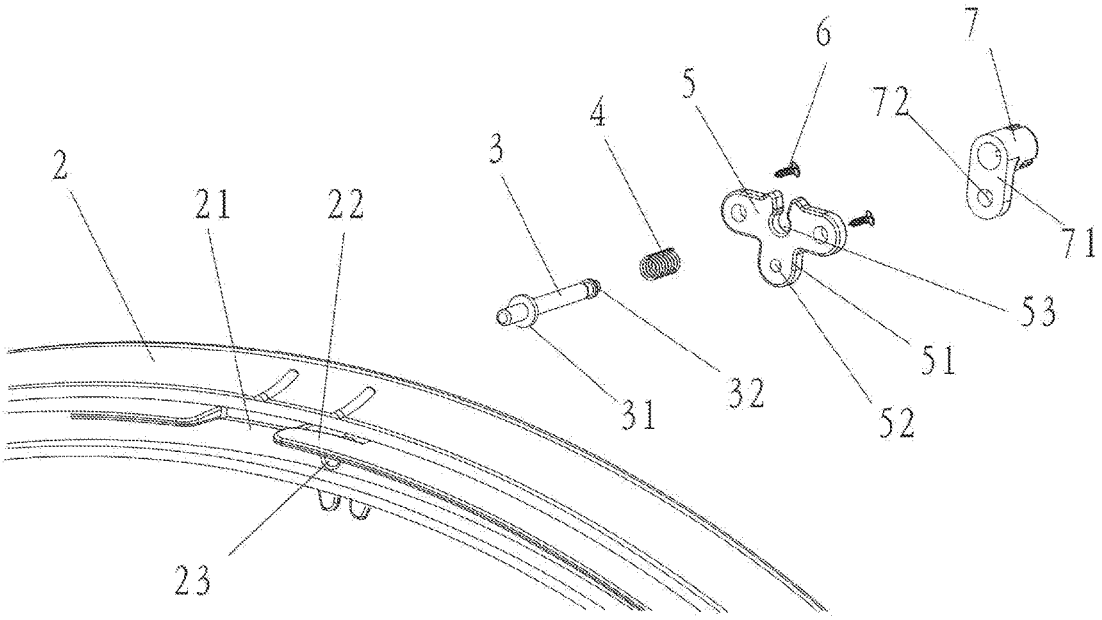
FIG. 2 is the local enlargement diagram of part A in FIG. 1.
Figure 3:
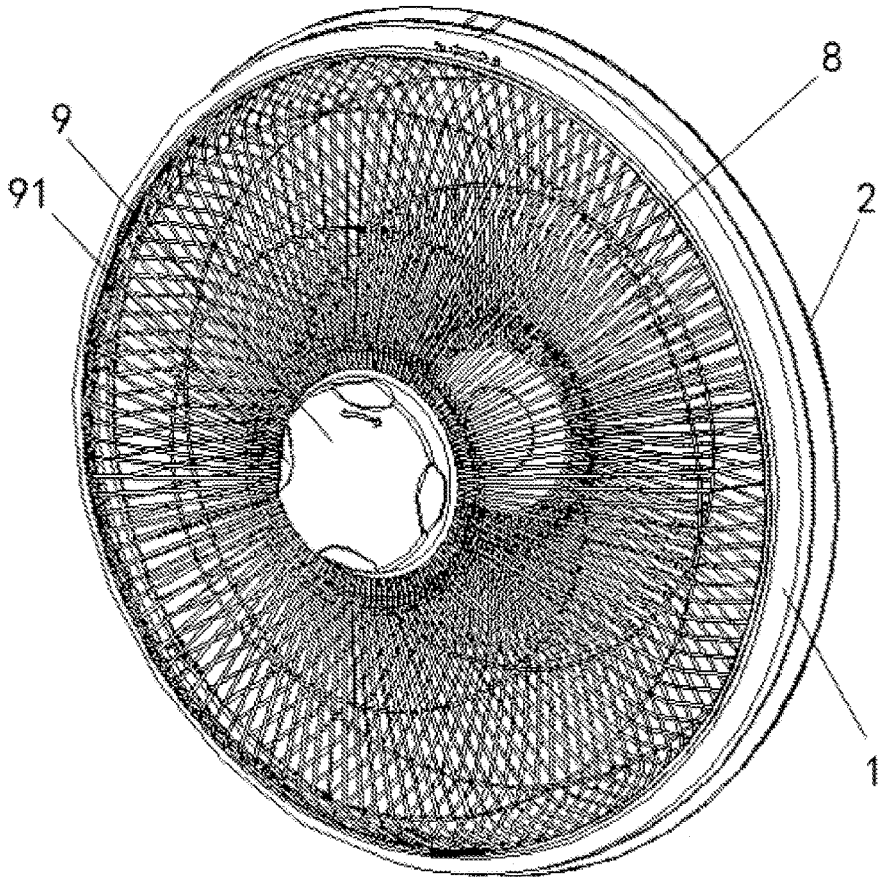
FIG. 3 is the schematic diagram of the housing of the embodiment.

As shown in figures, the embodiment comprises a front housing 8 and a rear housing, wherein the front and rear housings are respectively provided with a circular encircling ring which is used for mutual fixing, being the front encircling ring 1 and the rear encircling ring 2; the front housing 8 is provided with a handling cover 9 at the center, and the handling cover 9 protrudes relative to surface of the front housing 8, with multiple concave parts 91 uniformly distributed at the lateral sides of the handling cover 9; the front and rear encircling rings are circular, four protruding ends are provided on the inner wall of the front encircling ring 1, while four slots 21 and protruding edges 22 are correspondingly provided on the outer wall of the rear encircling ring 2; a fixing device, which comprises a draw bar 3, a spring 4 and a pressing plate 5, is provided at one slot 21 of the rear encircling ring 2; wherein the pressing plate 5 is fixed under one slot 21 of the rear encircling ring through screw 6; the draw bar 3 is provided with a top lug boss 31 and a bottom lug boss 32 and is sleeved with a spring 4, and top end of the spring 4 leans against the top lug boss 31 and bottom end of the spring 4 leans against the pressing plate 5; the fixing device further comprises a lock sleeve 7 which is sleeved on the bottom lug boss 32 of the draw bar; the lock sleeve 7 is provided with a lower extension surface 71, on which a lower mounting hole 72 is provided, and an upper extension surface 51 with an upper mounting hole 52 is provided on the pressing plate 5 at the corresponding position, and a bolt can be inserted into the mounting holes to fix the lock sleeve and the pressing plate; a first through hole 53 is provided on the pressing plate 5, a third through hole 23 is provided at bottom of the slot on the rear encircling ring and a second through hole is provided on the protruding end of the front encircling ring, and the three through holes are aligned and in clearance fit with the draw bar 3.

While mounting, pulling up the draw bar 3 of the fixing device through the lock sleeve 7 at first, the spring 4 being pressed at this time, aligning and fastening the protruding ends 11 of the front housing 1 and the slots 21 of the rear housing 2 correspondingly, and rotating for a certain angle to make the convex part of the rear encircling ring 2 clamped in the circle of the front encircling ring 1, thus to finish primary fastening; at this time, the first through hole 53 of the pressing plate 5, the third through hole 23 at bottom of the slot 21 on the rear encircling ring and the second through hole on the protruding end 11 of the front encircling ring are aligned; then releasing the lock sleeve 7, under action of electric force of the spring, the draw bar 3 of the fixing device being passed through the first through hole 53 of the pressing plate 5, the third through hole 23 at bottom of the slot 21 on the rear encircling ring and the second through hole on the protruding end 11 of the front encircling ring, thus to finish the fixing; and at last, aligning the upper mounting hole 72 of the lock sleeve 7 and the lower mounting hole 52 of the pressing plate 5, and fixing through the bolt. While dismantling, the bolt between the lock sleeve 7 and the pressing plate 5 being removed at first, then pulling up the draw bar 3 through the lock sleeve 7, rotating the front encircling ring 1 inversely to make it apart from the rear encircling ring. At the same time, the handling cover 9 on the front encircling ring 8 can be used to mount or dismantle the whole front housing 8, and the concave groove 91 on the handling cover 9 can be used for handling and preventing it from slipping.

The invention claimed is:

1. A fan housing with encircling rings, comprising a front housing and a rear housing, wherein the front and rear housings are respectively provided with a circular encircling ring which is used for mutual fixing; multiple protruding ends are provided on the inner wall of the front encircling ring, while multiple slots are correspondingly provided on the outer wall of the rear encircling ring, so that the front and rear housings can be fastened together through match of the protruding ends and the slots; besides, the front housing is provided with a handling cover at the center, and the handling cover protrudes relative to surface of the front housing, with multiple concave parts provided at the lateral sides; a fixing device, which comprises a draw bar, a spring and a pressing plate, is provided at one slot of the rear encircling ring; wherein the pressing plate is fixed under one slot of the rear encircling ring through screw, and is provided with a first through hole, through which the draw bar is in clearance fit with the pressing plate; the draw bar is provided with a top lug boss and is sleeved with the spring, and top end of the spring leans against the top lug boss and bottom end of the spring leans against the pressing plate; a second through hole is provided on the protruding end of the front encircling ring, and a third through hole is provided at a bottom of the slot on the rear encircling ring, the second through hole and the third through hole is aligned with the first through hole of the pressing plate during fastening, and the three through holes are all in clearance fit with the draw bar.

2. The fan housing with encircling rings according to claim 1, wherein there are four concave parts uniformly distributed on lateral side of the handling cover.

3. The fan housing with encircling rings according to claim 1, wherein the fixing device further comprises a lock sleeve, and a bottom lug boss is provided at bottom of the draw bar; the lock sleeve is sleeved on the draw bar and limited by the bottom lug boss.

4. The fan housing with encircling rings according to claim 3, wherein the lock sleeve is provided with a lower extension surface, on which a lower mounting hole is provided, and an upper extension surface with an upper mounting hole is provided on the pressing plate at the corresponding position; the lock sleeve and the pressing plate are fixed by mounting a bolt in the mounting hole.

* * * * *